US009259933B1

(12) United States Patent
Fima

(10) Patent No.: US 9,259,933 B1
(45) Date of Patent: Feb. 16, 2016

(54) INKJET PRINT HEAD CLEAN-IN-PLACE SYSTEMS AND METHODS

(71) Applicant: Nano-Dimensions Technologies, Ltd., Nes Ziona (IL)

(72) Inventor: Sharon Fima, Kibutz Palmahim (IL)

(73) Assignee: Nano-Dimension Technologies Ltd., Nes Ziona (IL)

( * ) Notice: Subject to any disclaimer, the term of this patent is extended or adjusted under 35 U.S.C. 154(b) by 0 days.

(21) Appl. No.: 14/626,192

(22) Filed: Feb. 19, 2015

(51) Int. Cl.
*B41J 2/165* (2006.01)

(52) U.S. Cl.
CPC ..... *B41J 2/1652* (2013.01); *B41J 2/165* (2013.01); *B41J 2/16505* (2013.01); *B41J 2/16511* (2013.01); *B41J 2002/16502* (2013.01)

(58) Field of Classification Search
CPC .... B41J 2/16511; B41J 2/16505; B41J 2/165; B41J 2/16502
See application file for complete search history.

(56) References Cited

FOREIGN PATENT DOCUMENTS

DE 19910943 A1 * 10/2000 ..... B41J 2/16505
WO WO 2011138729 A2 * 11/2011 ..... B41J 2/16526

* cited by examiner

*Primary Examiner* — Julian Huffman
(74) *Attorney, Agent, or Firm* — The IP Law Firm of Guy Levi, LLC; Guy Levi

(57) ABSTRACT

The disclosure relates to systems and methods for direct clean-in-place (CIP) of inkjet print heads. More particularly, the disclosure relates to systems and methods for facilitating CIP of inkjet print heads by selectably alternating the position of a mask disposed between the print head and a printing surface, between printing position, cleaning position and/or purging positions.

20 Claims, 5 Drawing Sheets

INKJET PRINT HEAD CLEAN-IN-PLACE SYSTEMS AND METHODS

BACKGROUND

The disclosure is directed to systems and methods for direct clean-in-place (CIP) of inkjet print heads. Specifically, the disclosure is directed to systems and methods allowing CIP of print heads by selectably alternating the position of a mask between printing, cleaning and purging positions.

Inkjet printing heads require periodic cleaning of printing nozzles to remove buildup (solid sediments) on the nozzles, remove air bubbles, and otherwise maintain printing quality. Cleaning the printing head is a significant part of the inkjet printing process, for example in some industrial settings the printing head is cleaned as often as every two minutes. The frequency of cleaning depends on the specific application for which the printing head is being used. Typically, cleaning can also be done by removing the print head to one side of the printer for easy access and manually cleaning the head. These methods are time consuming and inefficient.

An orifice plate, can be located on the printing side (lower surface) of the printing head, providing access for the nozzles to print, while potentially also providing protection for the printing head. Jetted ink from each nozzle can exits the orifice for printing. During periodic cleaning and/or after purging, the orifice surface can be cleaned to remove buildup, purged liquid, and enable proper jetting of the printing liquid from the nozzles (via the orifices). In order to preserve the smoothness and high interfacial tension between the printing side and the jetted ink (non-wetting characteristic) and the orifice surface, care must be taken in performing wiping.

Typically, removing content without contact to the orifice plate can be done using vacuum where a vacuum 'head' is moved across the orifice plate. The vacuum head can be maneuvered sufficiently close to allow the vacuum induced suction, to remove the jetted liquid from the orifice plate. Because the vacuum head does not contact the orifice plate, efficiency of the orifice plate cleaning is low. Typically, where an injection bath is present, the print head move to one side of the printer to purge the ink, which is time consuming and otherwise inefficient. Other disadvantages to conventional vacuum removal include cost, printing speed, reliability, and quality.

Moreover, when the ink contains volatile components, the ink at a tip of a nozzle may lose those components, resulting in certain circumstances in the remaining ingredients of the ink forming a semi-solid skin at the nozzle tip. The semi-solid skin, or buildup of solid sediments, can interfere with the jetting of ink from the nozzles, reducing the quality or even disabling jetting of ink from one or more nozzles. As the nozzle tips are aligned with orifices in an orifice plate, sediment buildup can also be on the orifices and/or orifice plate.

There is therefore a need for a system for cleaning an orifice plate, with increased efficiency over conventional techniques, and preventing sediment buildup.

SUMMARY

Disclosed, in various embodiments, are systems and methods for direct clean-in-place (CIP) of inkjet print heads. Also disclosed, are embodiments of systems and methods allowing CIP of print heads by selectably alternating the position of a mask between printing, cleaning and purging positions.

In an embodiment provided herein is a cleaning-in-place system for inkjet printing heads comprising: a mask having an upper surface and a lower surface, the mask defining: a cleaning window; a printing slit; and a purge well recessed into the upper surface of the mark; a print head having a distal end, a proximal end, a longitudinal axis, and a transverse axis the distal end having lower surface defining at least one orifice; a three (3) dimension alignment assembly, operably coupled to the print head and the mask; and a bracket, operably coupled to the alignment assembly, wherein the mask is configured to selectably align the cleaning window, the printing slit, or the purge well with the printing head's at least one orifice.

In another embodiment, provided herein is a method of cleaning-in-place an inkjet print head, comprising providing a clean-in-place system comprising: a mask having an upper surface and a lower surface, the mask defining a printing slit disposed between a cleaning window and a purge well recessed into the upper surface of the mask; and a print head having a distal end, a proximal end, a longitudinal axis, and a transverse axis the distal end having lower surface defining at least one orifice; selectably aligning the cleaning window or the purge well with the printing head's at least one orifice; cleaning or purging the printing head's one orifice; and aligning the at least one orifice with the printing slit.

These and other features of the methods, and systems for cleaning-in-place system of inkjet printing head(s), will become apparent from the following detailed description when read in conjunction with the figures and examples, which are exemplary, not limiting.

BRIEF DESCRIPTION OF THE FIGURES

For a better understanding of the methods, and systems for cleaning-in-place system of inkjet printing head(s), with regard to the embodiments thereof, reference is made to the accompanying examples and figures, in which.

DETAILED DESCRIPTION

Figure 1:
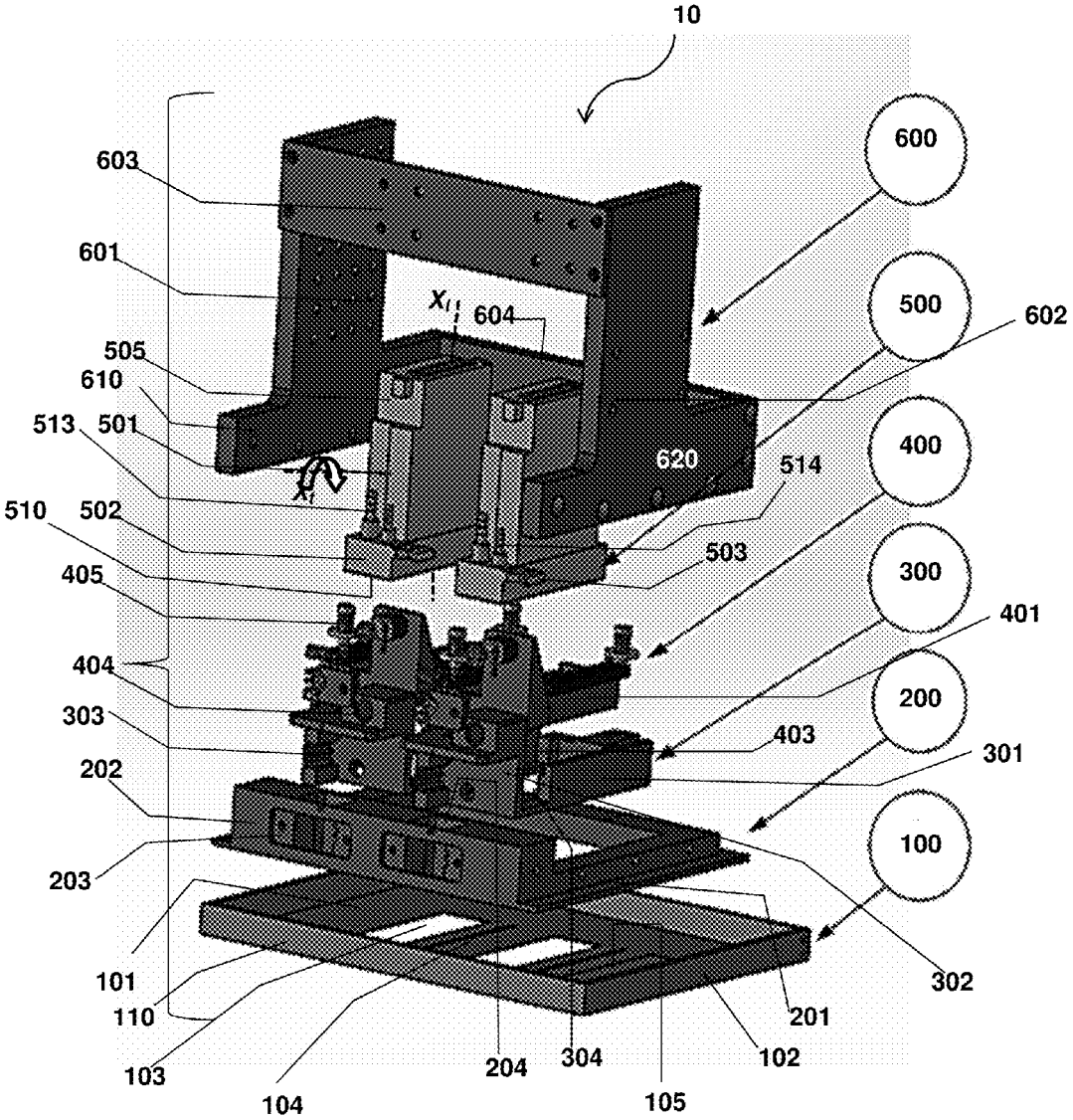
FIG. 1 illustrates an exploded isometric view of an embodiment of the system for cleaning-in-place system of inkjet printing head(s)

Provided herein are embodiments of systems and methods for cleaning-in-place of inkjet print head(s).

In an embodiment, provided herein is a system capable of regulating the temperature of inkjet printing heads while allowing the printing heads to be cleaned in place (CIP, in other words, without disassembling any of the components of the system, or otherwise changing the position of the printing head relative to the printed surface). The system comprises an insulating mask disposed between the printing head(s) and the printing surface, which can be, for example, a substrate, a printed circuit board, a paper and the like. The printed surface can be held at a predetermined temperature, while the print head(s), using the insulating mask, can be maintained at the same or different temperature.

The mask can include one or more printing slits corresponding to one or more nozzles (or printing head(s)). The slits are positioned and sized to allow jetted ink from the nozzles to pass through the mask (via the corresponding slit) to the printed surface. For example, row of nozzles on the orifice plate can be offset from the edge of the slit, to shield the nozzles from fumes potentially emitted from the printed surface and excessive heat emitted from the printing substrate. The mask plate can further define a cleaning window, providing easy access for the printing head(s). The cleaning window is substantially larger than the printing slit and be configured to provide access to the entire lower surface of the print head(s). In addition, the mask can have an upper surface defining a purge well recessed into the surface. The spatial arrangement of the printing slit, the cleaning (e.g., wiping) window and the purge well can be interchangeable. For example, and in an embodiment, the printing slit is disposed between the cleaning window and purge well. In this configuration, the mask can be translated a first distance from alignment of the orifice(s) (e.g., on an orifice plate disposed on the lower surface of the print head(s)) above the printing slit, to be aligned over the purge well, or, translated in the opposite direction such that the orifice(s) is(/are) aligned over the cleaning window.

A suction tube can be either static (fixed in place) or mobile (selectably maneuvered) and be positioned in fluid communication with the purge well. The term "fluid communication" refers to any area, a structure, or communication that allows for fluid communication between at least two fluid retainment regions, for example, a tube, duct, conduit or the like connecting two regions. One or more fluid communication can be configured or adapted to provide for example, vacuum driven flow, electrokinetic driven flow, control the rate and timing of fluid flow by varying the dimensions of the fluid communication passageway, rate of circulation or a combination comprising one or more of the foregoing. In an embodiment, the term "selectably" means that the subsequent operation can be done upon demand by a user without affecting other operations and/or elements. The ink and other components (e.g., build up residue, solid sediment and the like) suctioned off using the system described herein can be transported to a recycling system, modified and returned to the print head ink reservoir. The recycling sub-system may comprise various components, for example filters, adsorbing elements, manifolds, addition of various solvents and additives and the like. Generally, the term "recycling" refers to a sub-system used to reprocess the purged content of the purge well to a condition where it can be used effectively in the printing operation carried out.

Accordingly, provided herein is a cleaning-in-place system for inkjet printing heads comprising: a mask having an upper surface and a lower surface, the mask defining: a cleaning window; a printing slit; and a purge well recessed into the upper surface of the mark; a print head having a distal end, a proximal end, a longitudinal axis, and a transverse axis the distal end having lower surface defining at least one orifice; a three (3) dimension alignment assembly, operably coupled to the print head and the mask; and a bracket, operably coupled to the alignment assembly, wherein the mask is configured to selectably align the cleaning window, the printing slit, or the purge well with the printing head's at least one orifice.

The terms "first," "second," and the like, when used herein do not denote any order, quantity, or importance, but rather are used to denote one element from another. The terms "a", "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the head(s) includes one or more head). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

In addition, for the purposes of the present disclosure, directional or positional terms such as "top", "bottom", "upper," "lower," "side," "front," "frontal," "forward," "rear," "rearward," "back," "trailing," "above," "below," "left," "right," "radial," "vertical," "upward," "downward," "outer," "inner," "exterior," "interior," "intermediate," etc., are merely used for convenience in describing the various embodiments of the present disclosure.

The term "coupled", including its various forms such as "operably coupled", "coupling" or "coupleable", refers to and comprises any direct or indirect, structural coupling, connection or attachment, or adaptation or capability for such a direct or indirect structural or operational coupling, connection or attachment, including integrally formed components and components which are coupled via or through another component or by the forming process (e.g., an electromagnetic field). Indirect coupling may involve coupling through an intermediary member or adhesive, or abutting and otherwise resting against, whether frictionally (e.g., against a wall) or by separate means without any physical connection.

The mask, or mask plate used in the systems and methods for cleaning-in-place described herein can be jacketed. In other words, the mask plate can comprise various geometries of conduits embedded within the mask plate, configured to convey cooling and/or heating medium. The medium can be, for example, gaseous or liquid and be attached to a circulating pump and be further in electric communication with at least one sensor (e.g., thermometer) and a processor, configured to maintain a predetermined temperature or a programmable temperature profile throughout the printing process and the CIP process. For example, the system can comprise sensor array at various locations, with temperature data feedback to the processor, which, in turn, will control the cooling/heating medium (e.g., silicone oil) temperature and/or circulation rate. Temperature sensors can be positioned, for example, on the printed surface, the print head(s), the orifice plate(s), the purge well, inlet port, outlet port or a combination of location comprising one or more of the foregoing. Likewise, the mask can comprise various heating elements embedded within the mask plate and the liquid used is a cooling liquid whereby temperature is regulated and modulated by balancing the heating and cooling of the mask plate.

Other sensors can be incorporated into the system, for example, image (visual) sensors (e.g., CMOS, CCD, for example to monitor ink color, drop shape/volume), microflow (or flow) sensors (e.g., EM based, Resonant feedback based, Pitot-based) viscosity sensors, timing sensors, conductivity sensors, or an array comprising one or more of the foregoing. The sensors, including the temperature sensors can provide data to a processor comprising memory having thereon computer-readable media with a set of executable instruction enabling the processor, being in electronic communication with a driver, to automatically (in other words, without user intervention) change the position of the cleaning window, printing slit and purge well in the mask, relative to the print head. The processor may also determine whether purging ink from the print head will be jetted through the printing slit (for example, during initial operation), or purged into the purge well and recycled back to an ink reservoir in fluid communication with the print head.

The processor can further have a memory module with computer readable media stored thereon, comprising a set of instructions thereon configured to carry out the CIP methods described herein, provide temperature controls, and the like.

The mask plate can be operably coupled to a driver. The driver can be, for example, a servo motor or any suitable driver, such as an electric motor, a pneumatic motor and/or any other suitable electrical, mechanical, magnetic or other motor or driver that can apply a torque force upon shaft and selectably cause the mask to translate along an axis relative to the print head(s). The driver can be coupled to the mask plate via rail(s) coupled to the mask plate and disposed along the edges of the mask plate.

The three dimensional alignment assembly can be configured to provide the printing head(s) with at least two degrees of freedom in Cartesian coordinates system and one degree of freedom in spherical coordinate system. The assembly can comprise a base frame having a front end and a back end; a side-to-side (STS) aligning frame, operably coupled to the base frame; and a front-to-back (FTB) aligning frame, operably coupled to the side-to-side aligning frame. The STS alignment frame (in other words, moving for example, in parallel with the printing direction) can have a front end with detents configured to operably couple to at least one adjustment box disposed on the front end of the base frame. The base-frame adjustment box can have means for translating the STS frame a predetermined distance in each direction. For example, the base-frame adjustment box can have a detent-engaging member, coupled to a beveled gear, which in turn is coupled to an adjustment screw or knob. The STS alignment frame can translate, for example, a distance of between about 0.001 mm and about 10.0 mm. Other configurations are possible and contemplated for the adjustment box and its coupling to the STS alignment frame detent.

The STS alignment frame can likewise comprise an adjustment box configured to operably couple to a detent disposed on the sides of the front-to-back alignment frame (FTB, or translation of the print head(s) in a direction perpendicular to the printing direction). The STS alignment frame adjustment box can be configured to affect the transverse (to the STS alignment direction) translation of between about 0.001 mm and 10.0 mm. The frames can be nested (one within the other), with the printing head centrally nested. Likewise, the print head(s) can have a distal end with an alignment tab, configured to modulate roll (as opposed to pitch and yaw) of the print head relative to the transverse axis, the alignment tab can operably couple to the FTB aligning frame and be engaged in adjustment box disposed on the FTB alignment frame. Adjustment knobs can be disposed on the printing head(s)' and operably couple to the adjustment box disposed on the FTB alignment frame. The term "engage" and various forms thereof, when used with reference to retention of a member (e.g., the detent), refer to the application of any forces that tend to hold two components together against inadvertent or undesired separating forces (e.g., such as may be introduced during use of either component). It is to be understood, however, that engagement does not in all cases require an interlocking connection that is maintained against every conceivable type or magnitude of separating force. Also, "engaging element" or "engaging member" refers to one or a plurality of coupled components, at least one of which is configured for releasably engaging a tab or detent. For example, the adjustment box can be considered an engaging element.

The lower surface of the print head (e.g., the printing side) can comprise an orifice plate, providing access for the nozzles, while also providing protection for the printing head, among other features. The nozzles can interface with the orifice surface via, for example, "cells", with the jetting-end of each nozzle having a cell that surrounds the nozzle. The opening of the cell to the orifice surface defines an orifice, whereby jetted ink from each nozzle exits the orifice for printing. The lower surface of the print head used with the systems and methods for CIP of inkjet print head(s) provided herein, can define a plurality of orifices arranged in a matrix having M columns by N rows.

In an embodiment, the systems for CIP of inkjet print head(s) provided herein, are used in the methods provided. Accordingly, provided herein is a method of cleaning-in-place an inkjet print head, comprising: providing a clean-in-place system comprising: a mask having an upper surface and a lower surface, the mask defining a printing slit disposed between a cleaning window and a purge well recessed into the upper surface of the mask; and a print head having a distal end, a proximal end, a longitudinal axis, and a transverse axis the distal end having lower surface defining at least one orifice; selectably aligning the cleaning window or the purge well with the printing head's at least one orifice; cleaning or purging the printing head's one orifice; and aligning the at least one orifice with the printing slit.

The methods of cleaning-in-place an inkjet print head described herein, can also comprise aligning the printing head's at least one orifice with the purge well; purging a content of the printing head through the at least one orifice into the purge well; and using the vacuum source, suctioning the content of the purge well, and for example, recycling the suctioned content back to the print head(s) reservoir. As indicated, the system can comprise various temperature systems. Accordingly, the methods of cleaning-in-place an inkjet print head described herein, can also comprise a step of modulating the temperature of the mask using air or liquid.

The term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives.

All ranges disclosed herein are inclusive of the endpoints, and the endpoints are independently combinable with each other. Furthermore, the terms "first," "second," and the like, herein do not denote any order, quantity, or importance, but rather are used to denote one element from another.

Likewise, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such.

A more complete understanding of the components, processes, assemblies, and devices disclosed herein can be obtained by reference to the accompanying drawings. These figures (also referred to herein as "FIG.") are merely schematic representations (e.g., illustrations) based on convenience and the ease of demonstrating the present disclosure, and are, therefore, not intended to indicate relative size and dimensions of the devices or components thereof and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

Turning now to FIG. 1, illustrating an isometric exploded view of an embodiment of the CIP system described herein. As illustrated, system 10 can comprise mask 100 having upper surface 101 and lower surface 110. Mask 100 can define cleaning window 103, printing slit 104 and have purge well recessed into upper surface 101 of the mask. System 10, further comprises at least one print head 500 having distal end 502, proximal end 505, longitudinal axis $X_l$, and transverse axis $X_t$. Distal end 502 can have lower surface 510 (or an orifice plate) defining at least one orifice 511 (not shown). System 10, can also comprise three (3) dimension alignment assembly (200-400), operably coupled to print head 500 and mask 100. As illustrated, system 10 can comprise bracket 600, operably coupled to the alignment assembly (200-400), wherein mask 100 can be configured to selectably align cleaning window 103, printing slit 104, or purge well 105 (see e.g., FIG. 5) with printing head's 500 at least one orifice 511.

Figure 2:
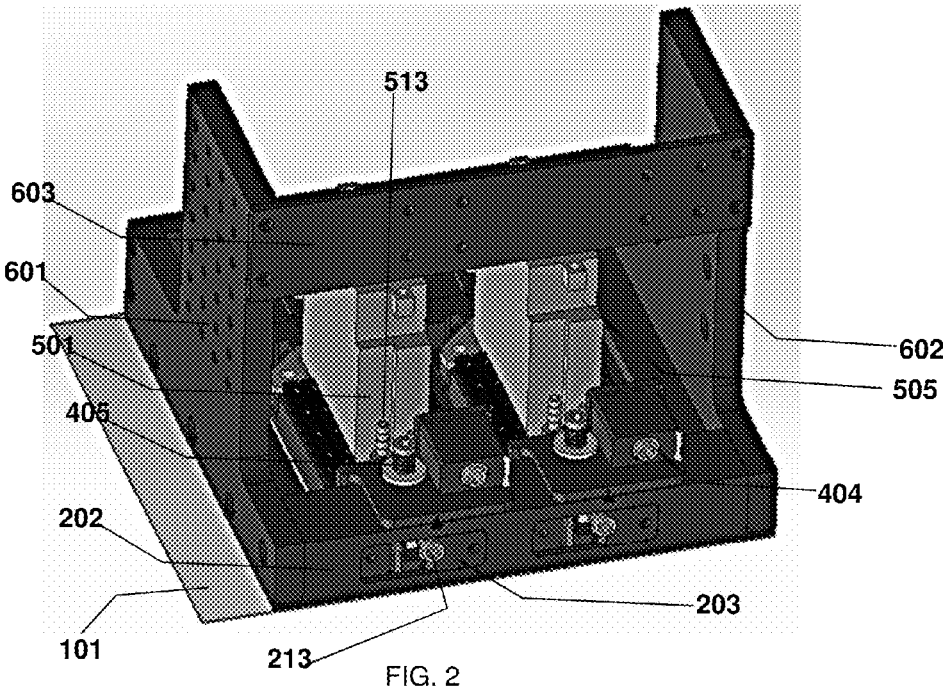
FIG. 2, illustrates a top left isometric view of the assembled embodiment illustrated in FIG. 1.

Further, and as illustrated in FIGS. 1-2, three dimensional alignment assembly (200-400) can be configured to provide printing head(s) 500 with at least two degrees of freedom in Cartesian coordinates system and one degree of freedom in spherical coordinate system. Assembly 200-400 can comprise flanged base frame 200 having a front end 202 and a back end (not shown). Also illustrated, is side-to-side (STS) aligning frame 300, operably coupled to base frame 200 and a front-to-back (FTB) aligning frame 400, operably coupled to side-to-side aligning frame 300. STS alignment frame 300 (in other words, moving in parallel with the printing direction) can have front end 302 with detents 303 configured to operably couple to at least one adjustment box 203 disposed on front end 202 of base frame 200. Flanged base-frame 200 adjustment box 203 can have means for translating STS alignment frame 300 a predetermined distance in each axial direction. For example, base-frame 200 adjustment box 203 can have detent 303 engaging member (not shown), coupled to a beveled gear, which in turn can be coupled to an adjustment screw 213 or knob. STS alignment frame 300 can translate, for example, a distance of between about 0.001 mm and about 10.0 mm. Other configurations are possible and contemplated for adjustment box 203 and its coupling to STS alignment frame 300 detent 303.

In addition, as shown in FIGS. 1 and 2, base frame 200 and alignment frames 300 and 400 frames can be nested (see e.g., FIG. 2) (one within the other), with printing head 500 centrally nested. Likewise, distal end 502 of print head 500 can have alignment tab 503, configured to modulate roll (as opposed to pitch and yaw) of print head 500 relative to transverse axis $X_t$ (see e.g., FIG. 1)., and Alignment tab 503 can operably couple to FTB aligning frame 400 and be engaged in adjustment box 404 disposed on FTB alignment frame 400. The roll affected by adjustment box 404 can be between about 0.1 radian and about 2.0 rad. Adjustment knobs 513, 514 can be disposed on distal end 502 of printing head 500 and operably couple to adjustment box 404 disposed on FTB alignment frame 400. As illustrated in FIG. 1, STS alignment frame 300, can have frame 301 with lateral wall 301 defining opening 304, configured to receive and engage alignment protrusion 403 extending from FTB alignment frame 400. Again, alignment box 404 can be operably coupled to alignment screw 405 (see e.g., FIG. 2) which, when turned or otherwise manipulated (e.g., pressure, pulling or bending), can affect translation of FTB alignment frame 400.

As also shown in FIG. 1, system 10, can comprise bracket 600, having first side wall member 601, second side wall member 602, anterior transverse member 603, and posterior transverse member 604. First and second side walls 601, 602 can have inferior end 610, 620 configured to operably couple to flanged base frame's 200 lateral walls 201 above base frame 200 flanged portion.

Figure 3:
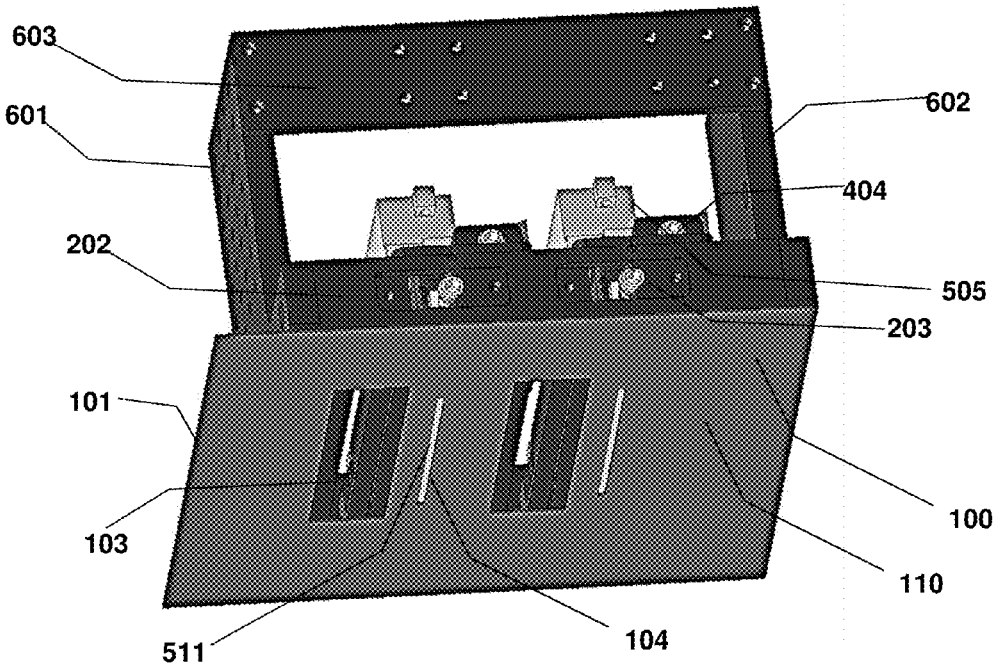
FIG. 3, illustrates a bottom left isometric view thereof, printing head aligned with printing slit.

Turning now to FIG. 3, illustrating system 10 in a lower isometric view during printing stage. As illustrated, mask 100 is configured with printing slit 104 defined in lower surface 110, disposed in between cleaning window 103 (also defined in lower surface 110) and purge well 105 (see e.g., FIG. 5) defined in mask 100, upper surface 101 (not shown, see e.g., FIGS. 1, 6). As illustrated, at least one orifice 511 in lower surface 510 of print head 500, is aligned with printing slit 104, allowing print head 500 to jet ink onto the printed surface. The term "ink" refers in an embodiment, in general to a material used for printing, and can include, but is not limited to homogeneous and non-homogenous materials, for example a carrier liquid containing metal particles to be deposited via the printing process or other jetted solutions, suspensions emulsions, gels or combination comprising one or more of the foregoing.

Figure 4:
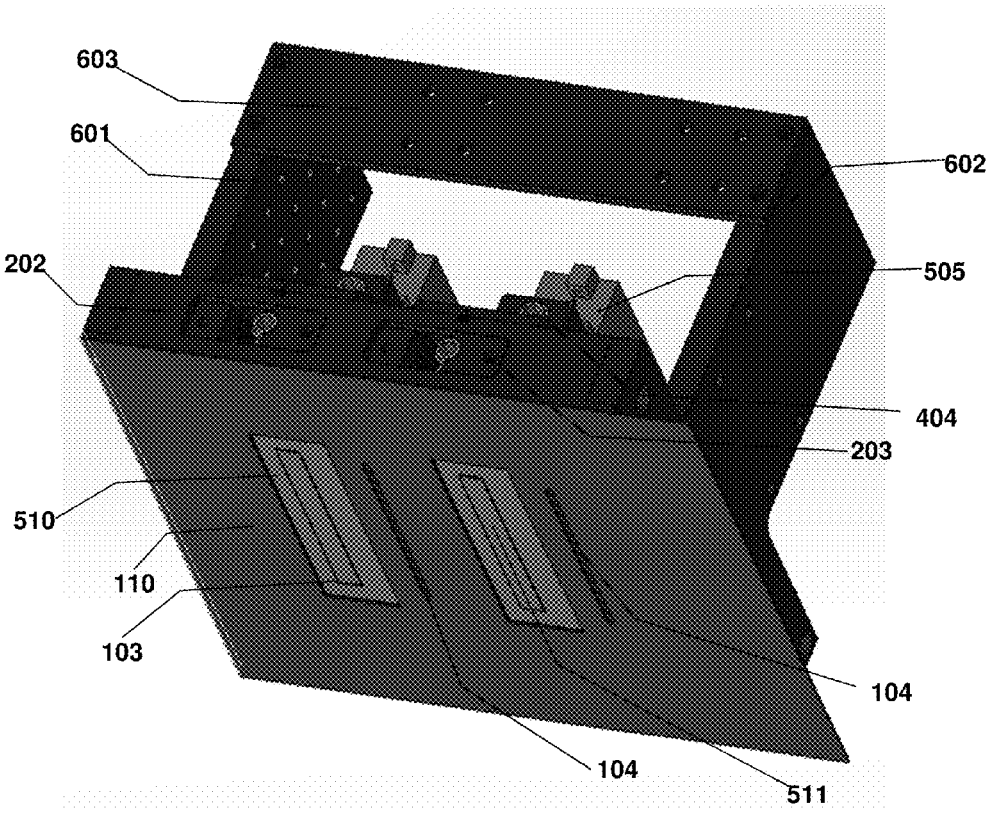
FIG. 4 illustrates a bottom left isometric view thereof, printing head aligned with cleaning window.

Turning to FIG. 4, illustrating system 10 in a lower isometric view during cleaning stage. As illustrated, mask 100 configured with printing slit 104 defined in lower surface 110, disposed in between cleaning window 103 (also defined in lower surface 110) and purge well 105 defined in mask 100, upper surface 101 (not shown, see e.g., FIGS. 1, 5). As illustrated, the at least one orifice 511 in lower surface 510 of print head 500, is aligned with cleaning window 103, allowing print head 500 to be cleaned using any wiping implement and easy access.

Figure 5:
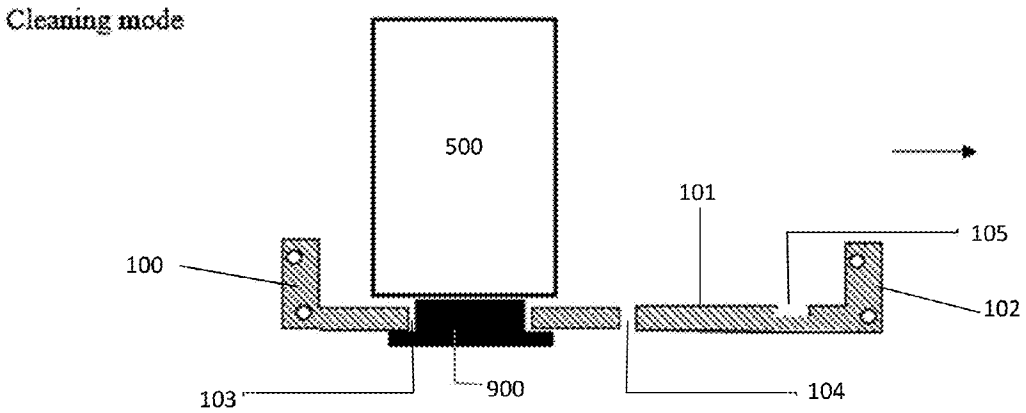
FIG. 5 illustrates a schematic Y-Z cross section view of the mask positioning during cleaning operation.

Turning now to FIG. 5, illustrating a X-Z cross section of the system illustrated in FIG. 4. As illustrated, mask 100 in system 10 can be translated in a first direction, causing printing slit 104 defined in lower surface 110 and disposed in between cleaning window 103 (also defined in lower surface 110) and purge well 105 defined in mask 100, upper surface 101 (not shown, see e.g., FIGS. 1, 5) to shift in the opposite direction, aligning cleaning window 103 with the at least one orifice 511 in lower surface 510 of print head 500 (see e.g., FIG. 5), allowing print head 500 to be cleaned using any wiping implement 900 (e.g., sponge, wiper, whether automated or manual) and easy access.

Figure 6:
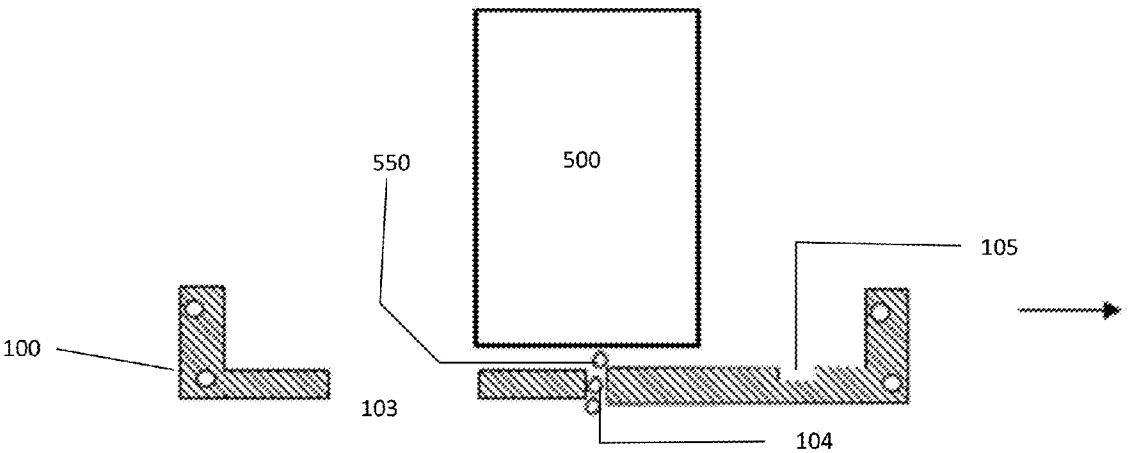
FIG. 6, illustrates a schematic Y-Z cross section view of the mask positioning during purging operation through the printing slit.

Turning now to FIG. 6, illustrating a X-Z cross section of the system 10 in a purge cycle of cleaning whereby the purged ink is jetted through the printing slit, directly to the printed surface. As illustrated, mask 100 in system 10 can be maintained in place, causing printing slit 104 defined in lower surface 110 and disposed in between cleaning window 103 (also defined in lower surface 110) and purge well 105 defined in mask 100, upper surface 101 keeping printing slit 104 aligned with the at least one orifice 511 in lower surface 510 of print head 500 (see e.g., FIG. 2), allowing print head's 500 ink 550 to be purged through print slit 104, directly onto the printed surface. In this position, mask 100 can still protect the at least one orifice 511 in lower surface 510 of print head 500 from heat or fumes generated by the printed surface.

Figure 7:
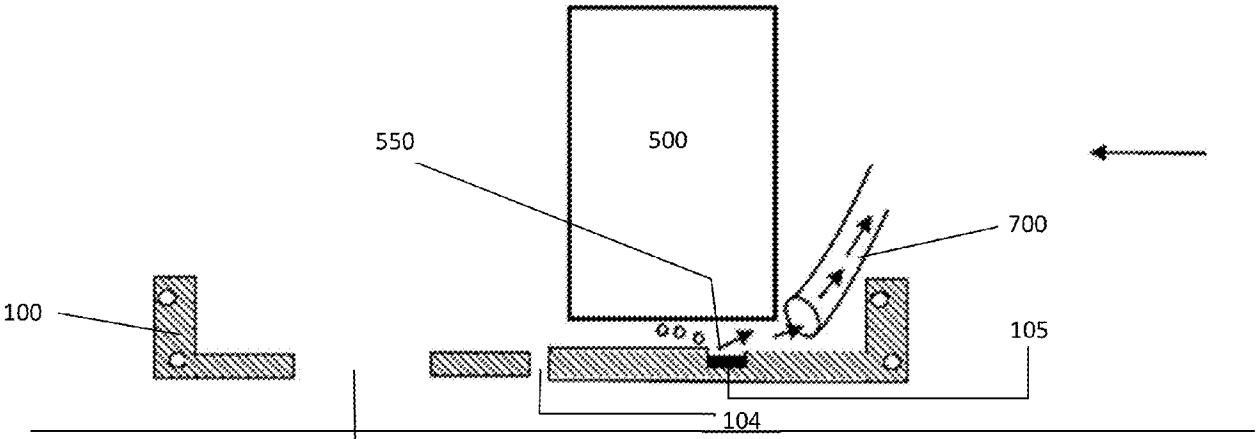
FIG. 7, illustrates a schematic Y-Z cross section view of the mask positioning during purging operation to the purge well

Turning now to FIG. 7, illustrating a X-Z cross section of the system 10 in a purge cycle of cleaning. As illustrated, mask 100 in system 10 can be translated in a second direction, causing printing slit 104 defined in lower surface 110 and disposed in between cleaning window 103 (also defined in lower surface 110) and purge well 105 defined in mask 100, upper surface 101 to shift in the opposite direction, aligning purge well 105 with the at least one orifice 511 in lower surface 510 of print head 500 (see e.g., FIG. 2), allowing print head 500 to be purged into purge well 105. Suction tube 700 can be either static (fixed in place) or mobile (selectably maneuvered) and be positioned in fluid communication with purge well 105. Ink 550 may also have sediment build up. Suction tube 700 can convey ink 550 to a recycling subsystem, which can return the ink to print head 500 reservoir (not shown).

Figure 8:
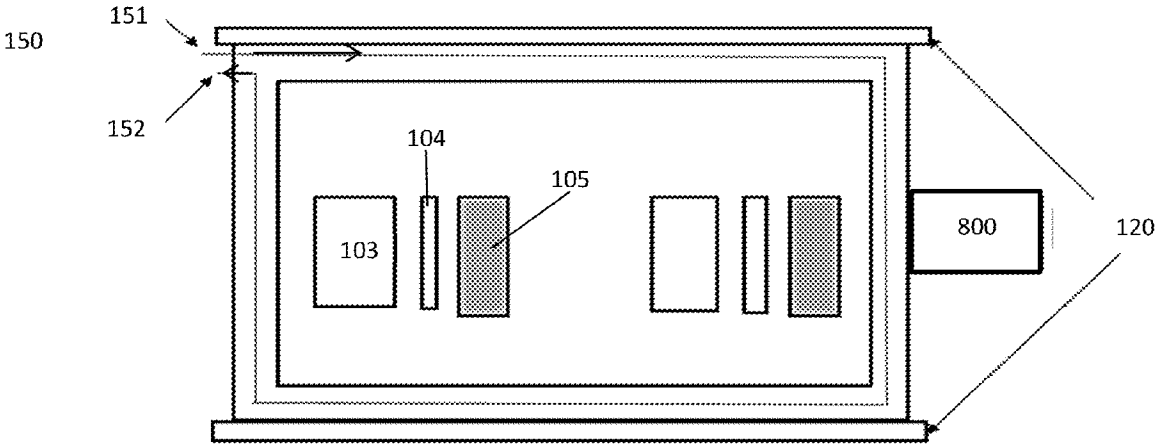
FIG. 8 illustrates a schematic X-Y cross section view of an embodiment of the mask.

Turning now to FIG. 8 where mask plate 100, shown with printing slit 104 defined in lower surface 110 and disposed in between cleaning window 103 (also defined in lower surface 110) and purge well 105 defined in mask 100, upper surface 101 can be operably coupled to driver 800 Driver 800 can be, for example, a servo motor or any suitable driver, such as an electric motor, a pneumatic motor and/or any other suitable electrical, mechanical, magnetic or other motor or driver that can apply a torque force upon shaft and selectably cause mask 100 to translate along an axis relative to the print head(s). Driver 800 can be coupled to the mask plate via rail(s) 120 coupled to mask plate 100 and disposed along the edges of mask plate 100. FIG. 7 also illustrates jacketing system having cooling/heating fluid/gas 150 entering through inlet port 151 and exiting through outlet port 152. Cooling/heating fluid/gas 150 can be in communication with a circulation means, for example, a positive displacement pump, diaphragm pump, centrifugal pump, reciprocating (e.g., simplex, duplex, triplex pumps), peristaltic pump or any other pump capable of circulating fluid or gas at predetermined and controllable velocities in response to command received for example, from a processor.

While in the foregoing specification the systems and methods allowing CIP of print heads by selectably alternating the position of a mask between printing, cleaning and purging positions have been described in relation to certain preferred embodiments, and many details are set forth for purpose of illustration, it will be apparent to those skilled in the art that the disclosure of the systems and methods allowing CIP of print heads by selectably alternating the position of a mask between printing, cleaning and purging positions is susceptible to additional embodiments and that certain of the details described in this specification and as are more fully delineated in the following claims can be varied considerably without departing from the basic principles of this disclosure.

What is claimed:

1. A cleaning-in-place system for inkjet printing heads comprising:

a. a mask having an upper surface and a lower surface, the mask defining:
   i. a cleaning window;
   ii. a printing slit; and
   iii. a purge well recessed into the upper surface of the mask;
b. a print head having a distal end, a proximal end, a longitudinal axis, and a transverse axis, the distal end having lower surface defining at least one orifice;
c. a three (3) dimension alignment assembly, operably coupled to the print head and the mask; and
d. a bracket, operably coupled to the alignment assembly, wherein the mask is configured to selectably align the cleaning window, the printing slit, or the purge well with the printing head's at least one orifice.

2. The system of claim 1, wherein the mask is jacketed.

3. The system of claim 2, wherein the jacketed mask is air or liquid jacketed.

4. The system of claim 3, further comprising a driver operably coupled to the mask.

5. The system of claim 4, wherein the system further comprises a suction tube operably coupled to the mask, the suction tube being in fluid communication with the purge well and a vacuum source.

6. The system of claim 5, wherein the three dimension alignment assembly comprises:

a. a base frame;
b. a side-to-side (STS) aligning frame, operably coupled to the base frame; and
c. a front-to back (FTB) aligning frame, operably coupled to the side-to-side aligning frame.

7. The system of claim 6, wherein the print head further comprises an alignment tab, configured to modulate roll of the print head relative to the transverse axis, the alignment tab operably coupled to the front-to-back aligning frame.

8. The system of claim 7, wherein the driver is operably coupled to the mask via at least a pair of rails.

9. The system of claim 5, wherein the suction tube is in further communication with an ink reservoir, the ink reservoir being in fluid communication with the print head.

10. The system of claim 1, wherein the printing slit is disposed between the cleaning window and the purge well.

11. A method of cleaning-in-place an inkjet print head, comprising:

a. providing a clean-in-place system comprising:
   i. a mask having an upper surface and a lower surface, the mask defining a printing slit disposed between a cleaning window and a purge well recessed into the upper surface of the mask;
   ii. a print head having a distal end, a proximal end, a longitudinal axis, and a transverse axis the distal end having lower surface defining at least one orifice; and
   iii. a bracket, operably coupled to an alignment assembly;
b. selectably aligning the cleaning window or the purge well with the printing head's at least one orifice;
c. cleaning or purging the printing head's one orifice; and
d. aligning the at least one orifice with the printing slit.

12. The method of claim 11, wherein the system further comprises a suction tube operably coupled to the mask, the suction tube being in fluid communication with the purge well and a vacuum source.

13. The method of claim 12, comprising:

a. aligning the printing head's at least one orifice with the purge well;
b. purging a content of the printing head through the at least one orifice into the purge well; and
c. using the vacuum source, suctioning the content of the purge well.

14. The method of claim 13, wherein the suction tube is in fluid communication with a reservoir operably coupled to the print head, the method further comprising the step of recycling the suctioned content back to the reservoir.

15. The method of claim 14, further comprising a step of modulating the temperature of the mask using air or liquid.

16. The method of claim 11, wherein the mask is jacketed.

17. The method of claim 11, wherein the system further comprising a driver operably coupled to the mask, configured to selectably align the print head's at least one orifice with the printing slit, the cleaning window, or the purge well.

18. The method of claim 17, wherein the driver is in communication with a processor coupled to a memory module having thereon a computer-readable medium with a set of executable instruction configured for automatically selectably aligning the print head's at least one orifice with the printing slit, the cleaning window, or the purge well.

19. The method of claim 18, wherein automatically selectably aligning the print head's at least one orifice with the printing slit, the cleaning window, or the purge well is in response to data obtained from a sensor.

20. The method of claim 19, wherein the sensor is a temperature sensor, visual sensor, flow sensor, viscosity sensor, conductivity sensor or a sensor array comprising one or more of the foregoing.

* * * * *